United States Patent [19]

Frechin et al.

[11] 4,027,896

[45] June 7, 1977

[54] SKI BINDING

[75] Inventors: Jean-Paul Frechin, Chamonix; Francis Vaudaux, Boege, both of France

[73] Assignee: Garcia Corporation, Teaneck, N.J.

[22] Filed: Mar. 4, 1976

[21] Appl. No.: 663,999

[30] Foreign Application Priority Data

Mar. 18, 1975 France ..... 75.08392

[52] U.S. Cl. ..... 280/618; 280/613

[51] Int. Cl.[2] ..... A63C 9/08

[58] Field of Search ..... 280/617, 618, 616, 614, 280/613, 620, 636, 611

[56] References Cited

UNITED STATES PATENTS

| | | | |
|---|---|---|---|
| 2,676,813 | 4/1954 | Beyl | 280/636 |
| 3,813,109 | 5/1974 | Salomon | 280/618 |
| 3,834,723 | 9/1974 | Erlebach | 280/613 |
| 3,944,237 | 3/1976 | Teague, Jr. | 280/618 |

FOREIGN PATENTS OR APPLICATIONS

| | | | |
|---|---|---|---|
| 1,926,108 | 11/1970 | Germany | 280/614 |

*Primary Examiner*—Joseph F. Peters, Jr.
*Assistant Examiner*—Milton L. Smith
*Attorney, Agent, or Firm*—Fitzpatrick, Cella, Harper & Scinto

[57] ABSTRACT

A ski binding comprises a mounting plate having means for securing a boot sole thereon and at least one rigid intermediate linkage member directly pivotally connected at one end to said plate and at another end to the upper face of a ski about parallel axes parallel to said face of the ski. The linkage member is connected to the ski by the intermediary of a piece pivoted on the ski about an axis perpendicular to the upper face of the ski and disposed substantially along the longitudinal axis of the ski. First elastic locking means carried by one of the ski or said pivoting piece prevent rotation of said plate, and second elastic locking means carried by the ski or said plate cooperate with the plate, or the linkage member or pivoting piece respectively to prevent raising of said plate relative to said ski, as long as forces exerted on the plate in at least one direction remain below a limiting value.

11 Claims, 10 Drawing Figures

SKI BINDING

The invention relates to safety ski bindings of the type comprising a mounting plate having means for securing a boot sole thereon, at least one rigid intermediate linkage member pivotally connected at one end to said plate and at another end to the upper face of a ski about parallel axes parallel to said face of the ski, means for pivoting said plate for rotation at least about an axis perpendicular to the plane of said plate, and elastic locking means for holding said plate against upward and rotational movement relative to said ski as long as forces exerted on the plate in at least one direction remain below a limiting value.

In known bindings of this type, for example as described in French Pat. No. 2,129,187, the means for pivoting the mounting plate consist of a piece rotatably mounted on the underneath face of the mounting plate, the intermediate linkage member being pivoted to this rotatable piece. Consequently, this rotatable piece and the elastic locking means serving to prevent rotation of the mounting plate are situated relatively high above the ski; in fact, these means are located between the mounting plate and the intermediate linkage member. In certain variations (FIGS. 1 and 5 of the aforementioned French patent), the rotational locking means are disposed at the same level as the mounting plate, or even above it (FIG. 18). This elevated position has the disadvantage of raising the center of gravity of the binding assembly in relation to the ski. Furthermore the elastic locking means preventing raising and, possibly, also rotation, protrude beyond the outer surfaces of the mounting plate and because of this are exposed to impacts. In two variations (FIGS. 11 and 15 of the aforementioned patent), the locking means are fully protected by the mounting plate, but the height of the binding is made considerably greater than for the other embodiments. In effect, in these variations, the locking means against raising of the plate are located under the intermediate linkage member, instead of being in front of or behind the mounting plate. Consequently, their height is added to the combined heights of the mounting plate and its pivoting piece as well as of the locking means preventing rotation of the plate, and of the linkage member itself.

Another object of the invention is to provide a ski binding of the stated type which avoids these disadvantages, and which allows, in the event of a fall of the skier, safety release of the boot and its mounting plate both upwards and in torsion, without the boot being fully freed from the ski, and in which after a torsional release the boot can be easily replaced in its normal skiing position by simply approximately aligning it with the ski, whereupon it is automatically aligned and locked.

The invention therefore proposes an improvement in such a binding in which the intermediate linkage member is directly linked to the mounting plate and is linked indirectly to the ski (i.e. to a base plate screwed on the ski) by means of a piece pivotally mounted on the ski about an axis perpendicular to the upper face of the ski and disposed substantially along the longitudinal axis of the ski. The locking means comprises a first elastic locking means carried by the ski or said pivoting piece and cooperating respectively with the pivoting piece or with a part fixed on the ski to prevent rotation of the mounting plate, and second elastic locking means carried by the ski or by the mounting plate and cooperating respectively (a) with the mounting plate or (b) with the intermediate linkage member or with the pivoting piece to prevent raising of the mounting plate. When the locking means are carried by the mounting plate, they are advantageously disposed below the lower face of the plate.

This binding has the advantage that the center of gravity of its mounting plate is low, in the immediate proximity of the upper face of the ski during skiing. Certain embodiments of this binding can be made particularly compact with all of its elements protected by the mounting plate without the thickness of the binding being increased.

The accompanying drawings show, by way of example, several embodiments of ski bindings according to the invention. In the drawings.

Figure 1:
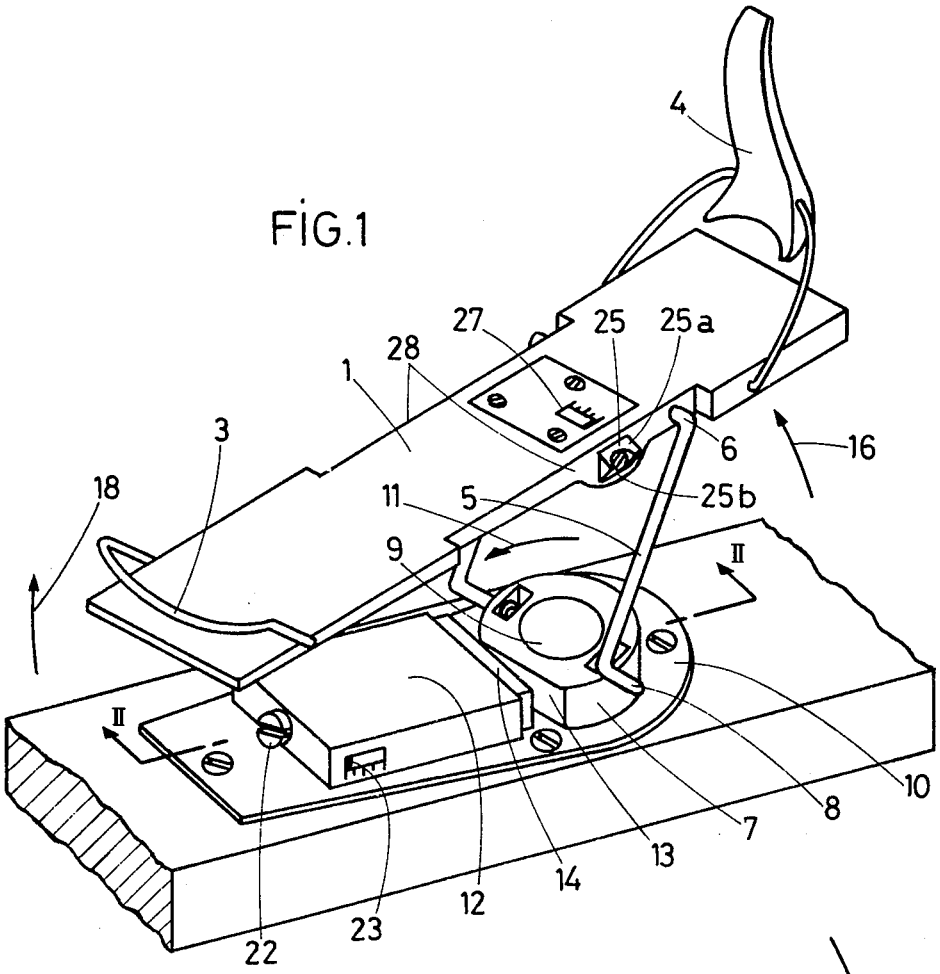
FIG. 1 is a perspective view of a first embodiment of binding in a released position.
Figure 2:
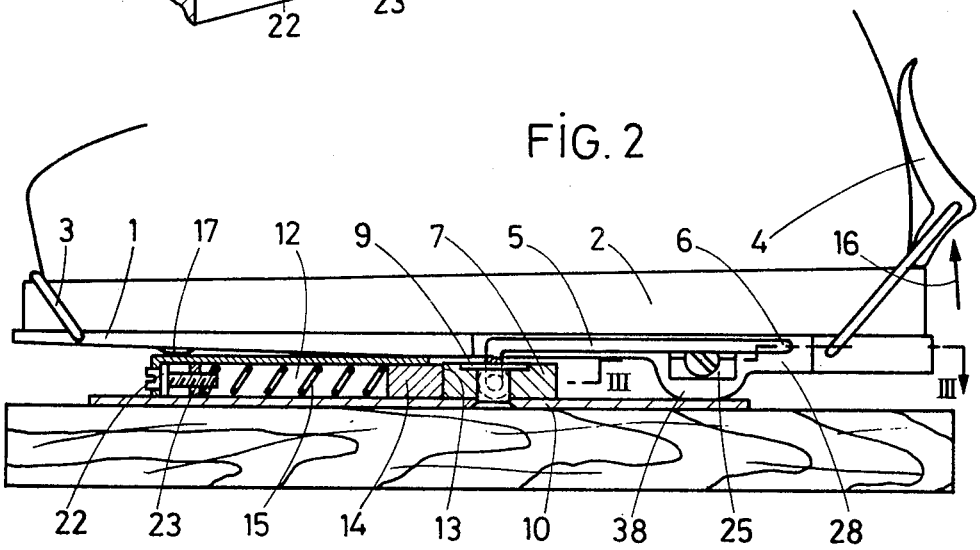
FIG. 2 is a cross-section along line II—II of FIG. 1 showing a boot held on a ski by the binding in a closed position.
Figure 3:
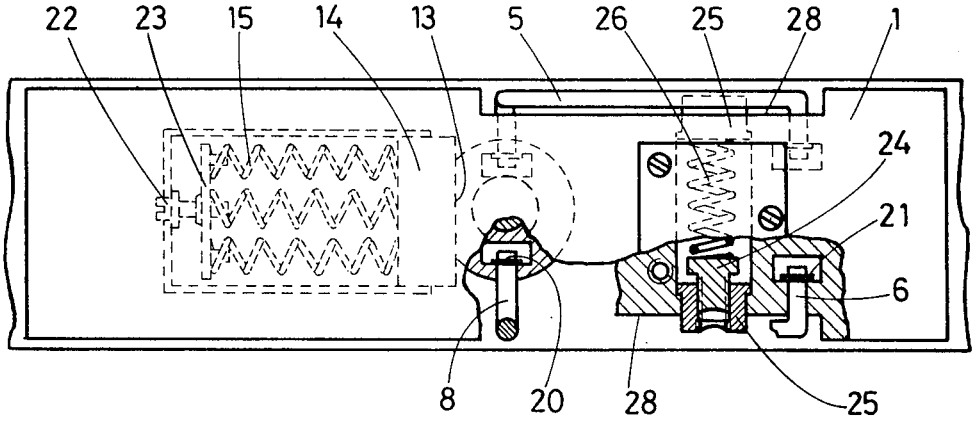
FIG. 3 is a partly cut-away schematic plan view of the first embodiment of binding in the closed position.

The ski binding shown in FIGS. 1 to 3 comprises a sole or mounting plate 1 to which a boot sole 2 may be secured by toe and heel loops 3 and 4. Plate 1 is connected to a ski by the intermediary of a linkage formed of two rigid arms 5 arranged symmetrically on either side of plate 1 in lateral-recesses 28 (FIG. 3). Arms 5 are articulated to plate 1, towards the rear end thereof, by two inwardly-bent ends 6 engaging in transverse holes in the recesses 28. At their other ends, arms 5 have downwardly-bent parts 8 with inwardly-bent ends, parallel to ends 6, by which they are articulated to a piece 7 about an axis parallel to ends 6, i.e. transverse to plate 1 and parallel to the upper face of the ski. Piece 7 is pivoted on a journal 9 supported on a base plate 10 screwed onto the upper face of a ski, so that the axis of journal 9 is perpendicular to the ski face and lies along the longitudinal axis of the ski.

The pivoted piece 7 is generally cylindrical but has a profiled part formed by a flat 13 perpendicular to the ski face. On base plate 10 is secured a housing containing elastic locking means, designated generally by 12, cooperating with flat 13 to tend to hold the arms 5 and plate 1 aligned with the ski. These locking means 12 comprise a piston 14 constantly pushed by compression springs 15 against flat 13. The pressure of springs 15 is adjustable by means of a screw 22 which can be turned to axially move a nut 23 supporting the ends of springs 15. The position of nut 23 is visible in a lateral window with graduations to enable control of the setting. The inwardly-bent ends 6,8 of arms 5 are retained by spring clips 21,20 respectively in cavities within plate 1 and piece 7.

Further elastic locking means are carried by plate 1 for cooperation with arms 5 to tend to prevent lifting of plate 1 from the ski. These locking means comprise two bolts 25 disposed transverse to plate 1, advantageously below the level of its lower face 17, and constantly outwardly biased into the lateral recesses 28 by a spring 26 (FIG. 3). Each bolt 25 has an inclined profiled end with faces 25*a* and 25*b* able to cooperate with the generally rounded arm 5. The force of spring 26 is adjustable by means of a headless screw 24 screwed in a threaded bore in one of the bolts 25. An inner end of screw 24 is visible through a window 27 in the upper face of plate 1, to display the setting. Under the rear part of plate 1 containing bolts 25 are bulges 38 for bearing against plate 10, to maintain the plate 1 in a horizontal rest position.

During skiing, the various elements normally occupy the position shown in FIGS. 2 and 3, in which plate 1 is held aligned with the ski by piston 14 acting against flat 13 and is held horizontal on the ski by the faces 25*a* of bolts 25 acting under lower parts of arms 5. In this position, the lower face 17 of plate 1 is situated immediately above the locking means cooperating with piece 7. The two arms 5 are nested within the width and thickness of plate 1. All of the elements serving to hold plate 1 in the normal skiing position are thus protected by the plate 1.

If a force greater than a given value is exerted by the boot in direction 16 or 18 to tend to lift plate 1, the arms 5 act against faces 25*a* of bolts 25 to cause them to withdraw against the action of spring 26, until the arms 5 are freed. The plate 1 can thus move to the position substantially as shown in FIG. 1. To replace the boot in the skiing position it suffices to press plate 1 down on the ski, and the bolts 25 snap to the locking position (FIGS. 2 and 3), by coaction of faces 25*b* then faces 25*a* of the bolts 25 against arms 5.

If a transverse force above a given value is exerted by the boot on plate 1, the piece 7 is pivoted in direction 11 (or the opposite direction) against the action of the elastic locking means 12. If the force in question ceases after a slight rotation of piece 7, as shown in FIG. 1, the piece 7 returns to its stable rest position with the plate 1 centered. However if the force continues, piece 7 and plate 1 continue to pivot. When the piston 14 moves off of the flat 13 and comes to bear against the cylindrical periphery of piece 7, the plate 1 is no longer biased back to the centered skiing position. To replace the binding, the boot is turned until the plate 1 is approximately aligned with the ski; as soon as the piston 14 acts against flat 13, the plate 1 is aligned automatically.

If a force greater than the release settings acts on the boot both upwardly and transversally, the plate 1 is simultaneously freed in both these directions.

Figure 4:
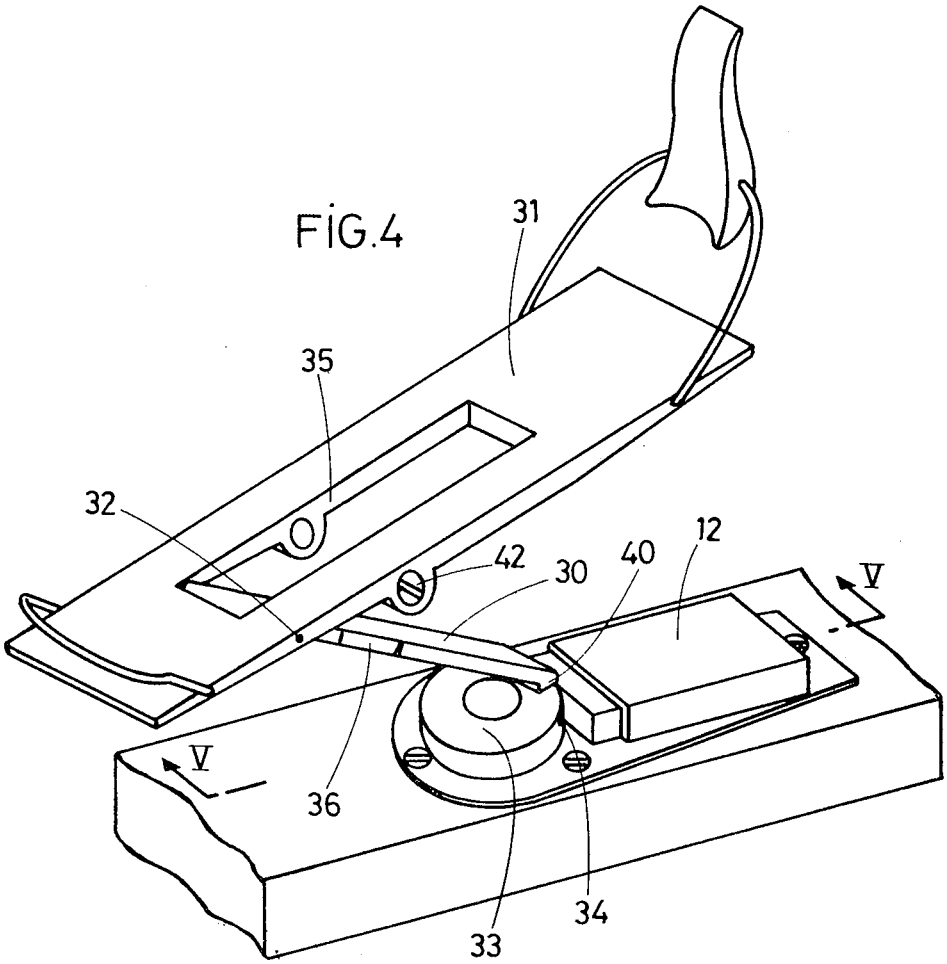
FIG. 4 is a perspective view of a varied form of the first embodiment of binding in the release position.
Figure 5:
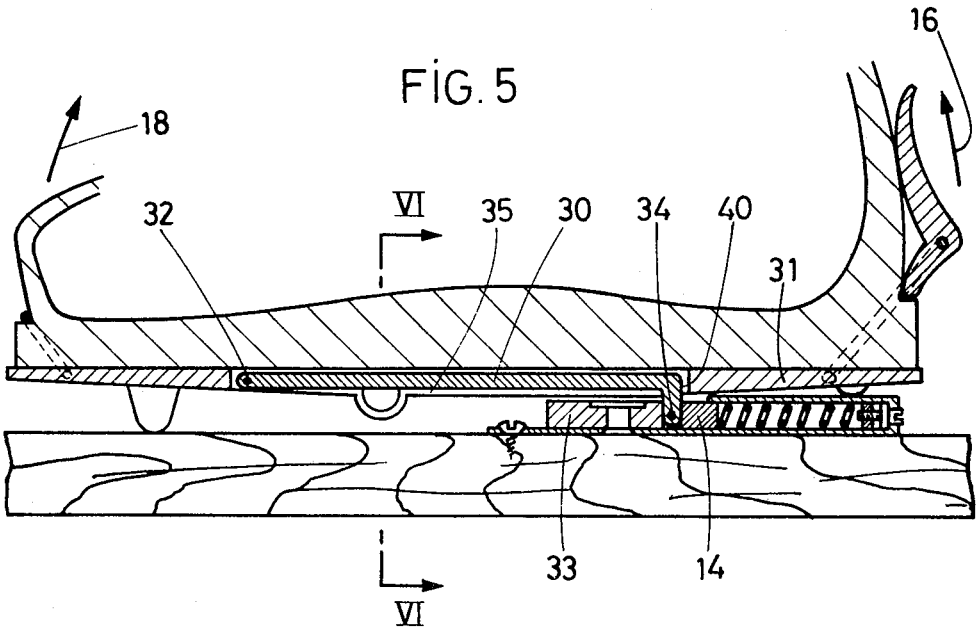
FIG. 5 is a cross-section along line V—V of FIG. 4, showing the varied form of binding in the closed position securing a boot on a ski.
Figure 6:
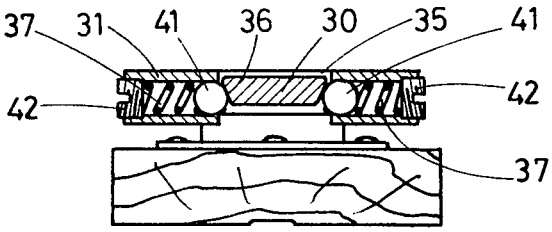
FIG. 6 is a cross-section along line VI—VI of FIG. 5

FIGS. 4 to 6 show a varied form of binding in which the pivoted linkage member is articulated to the front part of the mounting plate, instead of the rear part. In this form, a mounting plate 31 is connected to a ski by the intermediary of a single plate-like linkage member 30 disposed along the axis of plate 31. Member 30 is pivoted to plate 31 by transverse pins 32. The other end of member 30 has a downwardly-bent part 40 pivoted on a rotatable piece 33 by a pin 34 parallel to pins 32. When the binding is in the closed, normal-skiing position, member 30 is nested substantially within the thickness of plate 31 in an opening 35 of corresponding shape. Elastic locking means 12 cooperate with the part 40 to hold the member 30 and plate 31 in the closed position aligned with the ski. This bent part 40 thus replaces the flat 13 of the first embodiment.

As shown in FIG. 6, further locking means are provided between the plate 31 and member 30. These means comprise, on either side of opening 35, a ball 41 constantly biased by a spring 37 against an incline 36 provided on either side of member 30. The force of each spring 37 can be set at will by rotation of a screw 42. In this variation, the bulges 38 are provided towards the front of plate 31. All of the other elements are identical to those of the first embodiment.

This variation has a slight difference in operation in the case of raising of the plate 31 to the position of FIG. 4. This produces a slight movement of the bent part 40 towards piston 14 against the action of the locking means 12 which thus offers a greater resistance to release by pivoting of piece 33. Also, in this varied form, as shown notably in FIG. 4, the fact that the member 30 is articulated towards the front of plate 31 allows a greater movement of the boot in the case of a forward fall of the skier, in particular if the ski should become abruptly stopped. This variation, using a single linkage member, may also be incorporated in the following embodiments.

Figure 7:
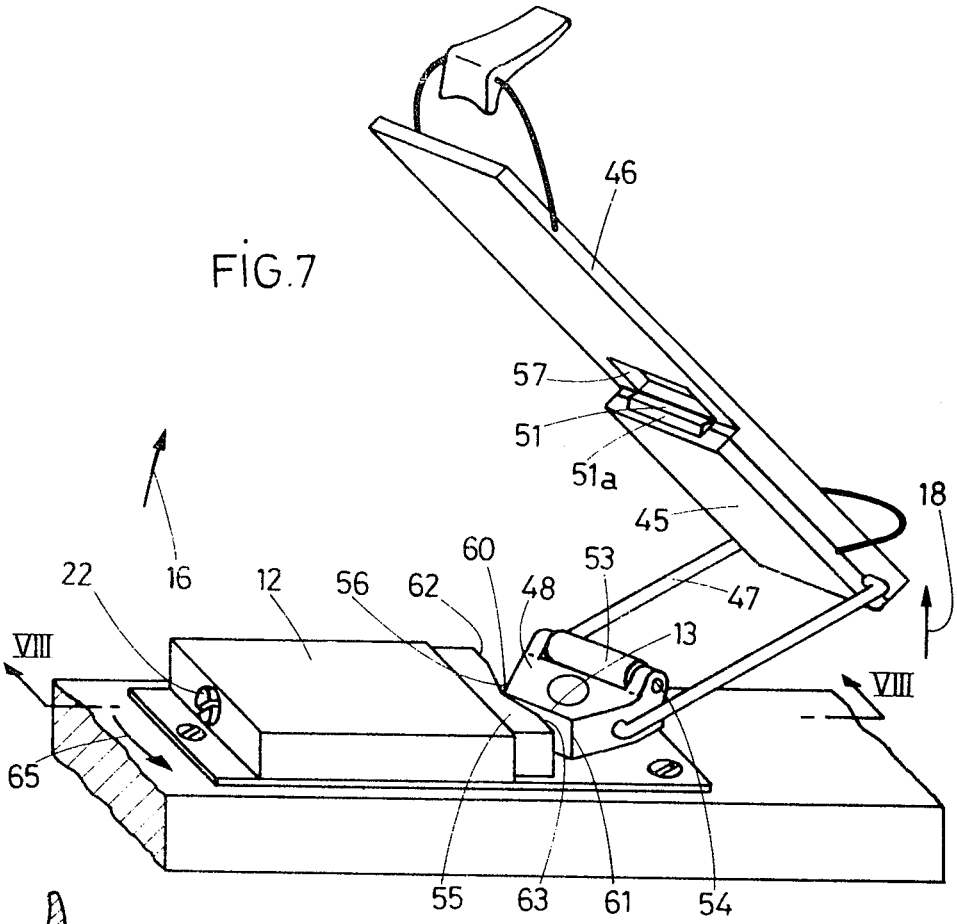
FIG. 7 is a perspective view of a second embodiment of binding in a released position.
Figure 8:
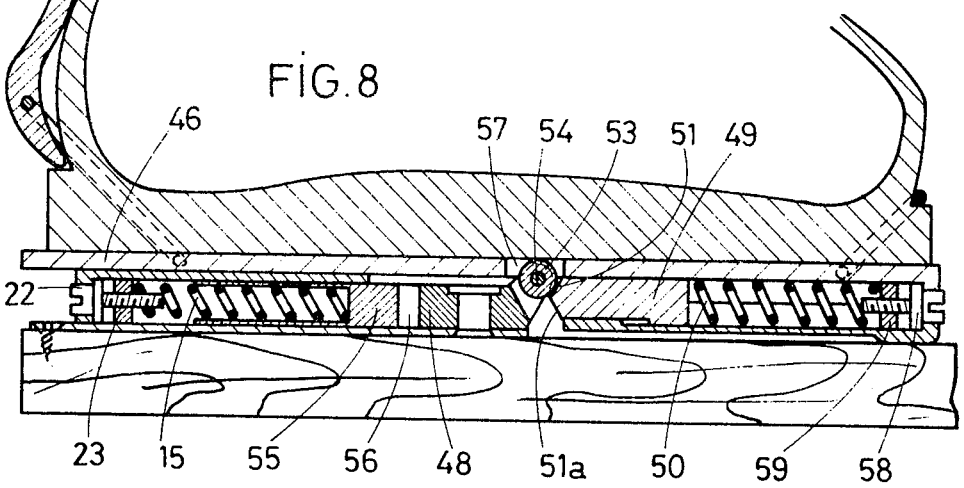
FIG. 8 is a cross-section along line VIII—VIII of FIG. 7 showing the binding in the closed position.

FIGS. 7 and 8 show a second embodiment in which elastic locking means 45 supported by a mounting plate 46 cooperate, not with the intermediate linkage member (in this case arms 47), but with a part carried by a pivoting piece 48, to prevent the plate 46 from being lifted up from the ski. The elastic locking means 45 comprise a piston 49 mounted for axial sliding movement along plate 46 and constantly biased by a compression spring 50. These locking means are disposed below the level of the lower face of plate 46. Piston 49 has an inclined profiled end 51 facing, and cooperating with, a roller 53 pivoted on member 48 about a pin 54 parallel to the upper face of the ski. A recess in the form of a slot 57 is provided in the plate 46 to receive the roller 53 when the plate 46 is held down on the ski, as shown in FIG. 8. A screw 58 and nut 59, similar to the previous screw 22 and nut 23, enable setting of the compression of spring 50.

The elastic locking means 55 have a piston 12 which could have a plane face, as the previously described piston 14, but in this particular embodiment has a central V-shaped recess 56 profiled so that when the pivoting piece 48 has been rotated from its rest position (FIG. 8), one of the ends 60, 61 of a flat 13 on piece 48 comes to bear on a respective face of said profiled recess 56 to tend to return the piece 48 to its rest position, at least during an initial pivoting of piece 48. Such a recess 56 could also be provided on the previously-described piston 14. All of the other elements are the same as for the first embodiment.

During skiing, the elements of the binding are in the position of FIG. 8. The profiled part 51 of piston 49 is held under roller 53 by the action of spring 50. Flat 13 of piece 48 bears by its lateral ends 60, 61 against corresponding plane parts 62, 63 of piston 55. Plate 46 rests on the casing which houses the elastic locking means 12.

A given, preset upward force exerted by the boot in direction 16 or 18 produces withdrawal of piston 49 against the action of spring 50. This allows the plate 46 to pivot up to a position similar to that of FIG. 7. If the force is applied transversally of the ski, for example as indicated by arrow 65, the pivoting piece 48 firstly pushes back the plane part 62 of piston 55 and then the recess 56 of piston 55. If the effort ceases after an initial part of the rotation of piece 48, the latter returns to its initial position. If the effort continues, the edge of piece 48 finally comes to engage in the bottom of recess 56 where it remains (FIG. 7).

Placing the binding back to the initial position takes place in the same manner as for the previous embodiments. Below its inclined profiled end 51, the piston has another oppositely-inclined part 51*a* facilitating replacement of the binding.

Figure 9:
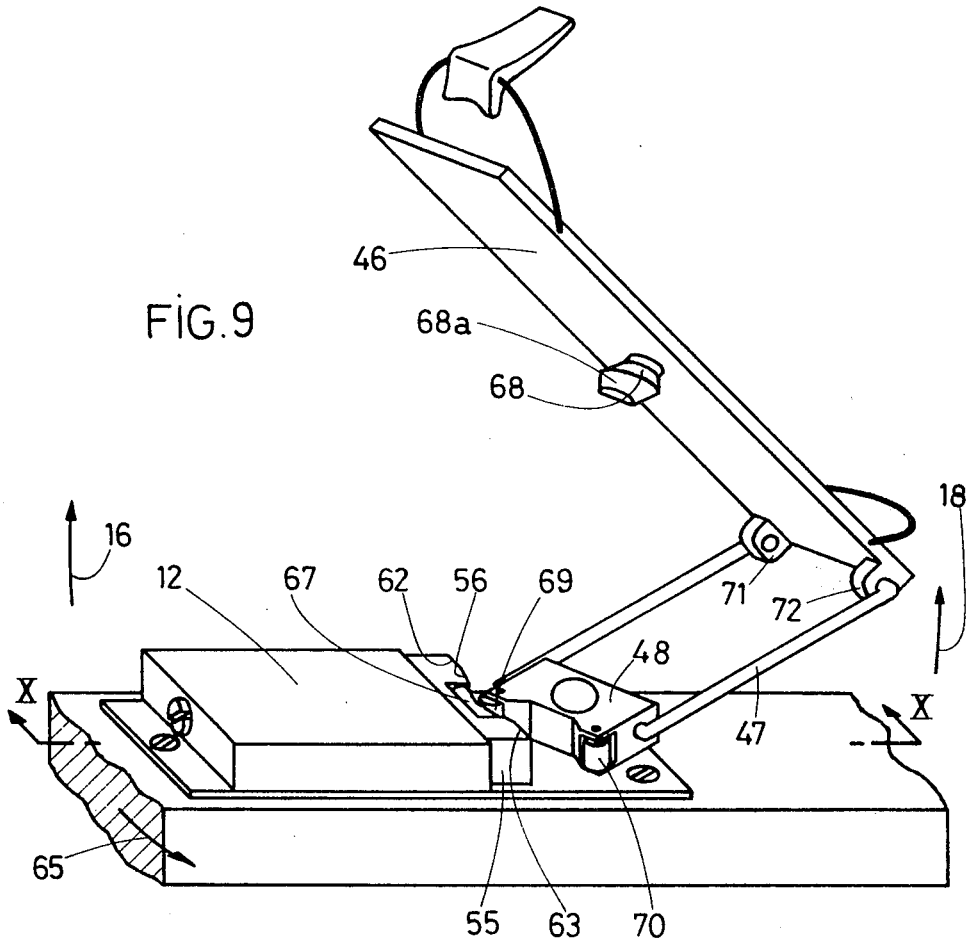
FIG. 9 is a perspective view of a third embodiment of binding in a released position.
Figure 10:
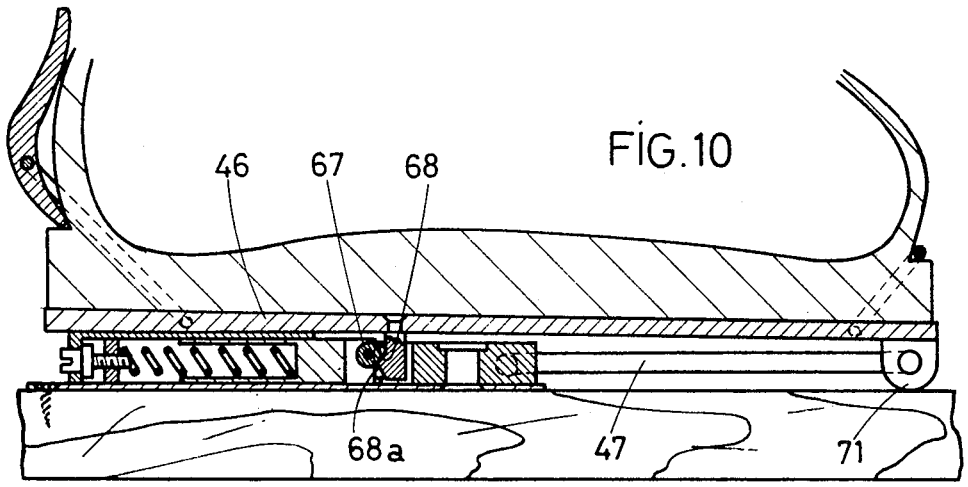
FIG. 10 is a cross-section along line X—X of FIG. 9 showing the binding in the closed position.

FIGS. 9 and 10 show a third embodiment in which the mounting plate 46 no longer carries any elastic locking means. Only the elastic locking means 12 of the second embodiment are used. The recess 56 is slightly modified; its central part is replaced by a roller 67 whose axis is transverse to the ski. When the plate 46 is in the closed, skiing position (FIG. 10), the profile of this roller cooperates with an inclined part 68 of complementary profile fixed under the plate 46. This inclined part 68 is thus inserted in the recess 56 and a corresponding recess in the piece 48. Also, the plane parts 62 and 63 of piston 55 cooperate with rollers 69, 70 pivotally mounted on piece 48 about vertical axes, instead of with the lateral ends 60, 61 of the pivoting piece 48. Alternatively, this embodiment could include the previous plane ends 60, 61; likewise, the earlier embodiments could include rollers such as 69, 70. These rollers could be carried by the pivoting piece or by the spring-urged piston cooperating therewith. Also, the plate 46 has at one of its ends, the front one in this example, two supports 71, 72 which support the plate in a substantially horizontal position at rest. All of the other elements are identical to those of the previously-described second embodiment.

During skiing, the elements normally occupy the position shown in FIG. 10. The profiled part 68 fixed under plate 46 is locked by the roller 67, and the rollers 69, 70 of piece 48 bear against the plane parts 62, 63 of the piston 55. The plate 46 is substantially horizontal, bearing on the one hand on the casing which houses the elastic locking means 12 and on the other hand on the ski by its supports 71, 72.

An upwardly-directed force along 16 or 18 is opposed by piston 55 which retracts and, when the force exceeds a given value, frees the inclined profiled part 68 and hence plate 46 which moves to a position similar to that of FIG. 9. If the force is exerted transverse to the ski, for example along 65, the pivoting piece 48 and plate 46 rotate in the same direction, and piston 55 is pushed in. As soon as the piston 55 has been slightly pushed in, the profiled part 68 is freed, which frees plate 46 for upward movement according to arrow 16. At the end of rotation, the roller 69 comes to be lodged in the recess housing roller 67.

Replacement of the boot takes place by firstly bringing the plate 46 approximately into alignment with the ski whereupon the piece 48 automatically provides exact alignment, then lowering the plate 46 until part 68 locks under roller 67. This is facilitated by an outer trunco-conical profile 68*a*.

In the described embodiments, the pivoting pieces are disposed substantially under the median part of the mounting plate, and the intermediate linkage member is pivoted to the mounting plate towards or at its front or rear end.

However, the pivoting piece could be disposed under the front or rear end of the mounting plate, the corresponding elastic locking means being preferably but not necessarily lodged under the mounting plate. In this case, the intermediate linkage member(s) would be articulated to the mounting plate substantially in its median part, or at its rear or front end.

What is claimed is:

1. In a ski binding of the type comprising a mounting plate having means for securing a boot sole thereon, at least one rigid intermediate linkage member pivotally connected at one end to said plate and at another end to the upper face of a ski about parallel axes parallel to said face of the ski, means for pivoting said plate for rotation at least about an axis perpendicular to the plane of said plate, and elastic locking means for holding said plate against upward and rotational movement relative to said ski as long as forces exerted on the plate in at least one direction remain below a limiting value, the improvement wherein said linkage member is directly linked to said plate and is linked to the ski by the intermediary of a piece pivoted on the ski about an axis perpendicular to the upper face of the ski and disposed substantially along the longitudinal axis of the ski, said locking means comprising first elastic locking means carried by one of said ski and said pivoting piece and cooperating with the other of said ski and said pivoting piece to normally prevent rotation of said plate, and second elastic locking means carried by one of said ski and said plate and cooperating with one of said plate, linkage member and said pivoting piece to normally prevent raising of said plate relative to said ski.

2. Ski binding according to claim 1, in which said pivoting piece is disposed substantially under a median part of said mounting plate, said intermediate linkage member being connected to an end part of said mounting plate.

3. Ski binding according to claim 1, in which said pivoting piece is disposed substantially under a first end part of said mounting plate, said intermediate linkage member being connected to said mounting plate at a location from a median part to a second end part thereof.

4. Ski binding according to claim 1, in which said mounting plate comprises means for defining therein at least one housing in which said at least one intermediate linkage member is retracted when the mounting plate is held against the ski.

5. Ski binding according to claim 1, in which said first elastic locking means comprises a piston carried by the ski, said piston having a profiled part, and means for biasing said piston to hold said profiled part against a part of corresponding profile on said pivoting piece.

6. Ski binding according claim 5, in which said parts of corresponding profile of said piston and said pivoting piece are plane faces.

7. Ski binding according to claim 5, in which one of said parts of corresponding profile of said piston and said pivoting piece is formed by at least two rollers mounted about vertical axes disposed towards lateral ends of said one part, the other of said parts of corresponding profile having corresponding lateral plane faces.

8. Ski binding according to claim 5, in which the profile of said piston comprises a substantially plane face having means defining a central recess therein, said profile cooperating with said pivoting piece to bias it towards a centered position at least during an initial pivoting of said piece.

9. Ski binding according to claim 8, in which said recess of said piston includes a profiled part cooperating, when said plate is lowered on said ski, with a part of complementary profile carried by said mounting plate to oppose raising of said plate.

10. Ski binding according to claim 1, in which said second elastic biasing means comprise at least one piston carried by said mounting plate, and elastic means biasing said piston transversally of said plate, said piston having a profiled end part cooperating with a part of complementary profile of said at least one intermediate linkage member.

11. Ski binding according to claim 1, in which said second elastic biasing means comprise a piston carried by said mounting plate, and means biasing said piston axially relative to said plate, said piston having an inclined profiled end part directed towards and cooperating with a part of complementary profile of said pivoting piece which is disposed parallel to the upper face of said ski.

* * * * *